United States Patent [19]

Toya

[11] Patent Number: 4,894,882

[45] Date of Patent: Jan. 23, 1990

[54] PORTABLE VACUUM CLEANER

[75] Inventor: Syouiti Toya, Sumoto, Japan

[73] Assignee: Sanyo Electric Company, Ltd., Osaka, Japan

[21] Appl. No.: 142,656

[22] Filed: Jan. 11, 1988

[30] Foreign Application Priority Data

Jan. 13, 1987 [JP] Japan ..... 62-5248

[51] Int. Cl.[4] ..... A47L 5/24

[52] U.S. Cl. ..... 15/344; 15/350; 15/353

[58] Field of Search ..... 15/344, 353, 350

[56] References Cited

U.S. PATENT DOCUMENTS

| | | | |
|---|---|---|---|
| 3,079,626 | 3/1963 | Yonkers et al. | 15/344 X |
| 3,230,569 | 1/1966 | Nielsen | 15/344 |
| 4,137,599 | 2/1979 | Steyer | 15/353 X |
| 4,238,869 | 12/1980 | Lachance | 15/353 |
| 4,380,845 | 4/1983 | Miller et al. | 15/344 |
| 4,542,557 | 9/1985 | Levine | 15/344 |

*Primary Examiner*—Chris K. Moore

*Attorney, Agent, or Firm*—Cohen, Pontani & Lieberman

[57] ABSTRACT

A portable vacuum cleaner for use in both dry and wet operations includes a main body case housing a fan motor and having intake and discharge openings, a dust case having a suction part and removably attached to the main body case around the intake opening, a filter housing removably installed in the dust case and having a filter accommodated therein to cover the intake opening with the filter, and a seal member peripherally interposed between the dust case and the main body case and/or filter housing. The filter housing has on the suction side of the constitutional wall thereof an annular wall which projects in an annular form toward the suction part and forms a well for water drawn in from the suction part, and also has a through hole positioned above the annular wall which permits the passage of air drawn in from the suction part.

10 Claims, 7 Drawing Sheets

PORTABLE VACUUM CLEANER

BACKGROUND OF THE INVENTION

1. Field of the Invention

The present invention relates to a portable vacuum cleaner capable of drawing in both dust and water.

2. Description of the Prior Art

U.S. Pat. No. 4,542,557 (corresponding to Unexamined Japanese Patent Publication SHO No. 60-188124) and U.S. Pat. No. 4,536,914, for example, disclose portable vacuum cleaners for cleaning by drawing in dust as mixed with water. These conventional cleaners comprise a cleaner main body having a fan motor incorporated therein, a dust case attached to the front side of the main body and integral with a suction nozzle, and means housed in the dust case for separating water and dust from the air drawn in. To prevent the water drawn in from reversely flowing out through the suction nozzle, the suction nozzle includes an extension in the form of a tube under the upper wall of the dust case and having a rear end opening close to the front side of the main body. However, these conventional cleaners have a disadvantage in that when the main body of the cleaner is stood upright, with the nozzle upward and the handle downward, water which is collected in the dust case flows into the main body of the cleaner via a through hole formed in the partition wall.

SUMMARY OF THE INVENTION

The present invention provides a portable vacuum cleaner for use in both dry and wet operations including a main body case housing a fan motor and having intake and discharge openings, a dust case having a suction part and removably attached to the main body case around the intake opening, a filter housing removably installed in the dust case and having a filter accommodated therein to cover the intake opening with the filter, and a seal member peripherally interposed between the dust case and the main body case and/or filter housing, wherein the filter housing has on the intake or suction side thereof an annular wall which projects in an annular form toward the suction part and forms a well for water drawn in from the suction part, and also has a through hole positioned above the annular wall which permits the passage of air drawn in from the suction part.

According to the present invention, the filter housing has a specific annular wall which forms a well for water drawn in from the suction part. Because of this structure, most water remaining in the dust case collects in the well and stays there but does not flow into the main body case of the cleaner via the through hole when the cleaner is stood upright with the suction part above the dust case.

BRIEF DESCRIPTION OF THE DRAWINGS

The accompanying drawings illustrate an embodiment of the portable vacuum cleaner of the invention.

DETAILED DESCRIPTION OF THE PREFERRED EMBODIMENTS

Figure 1:
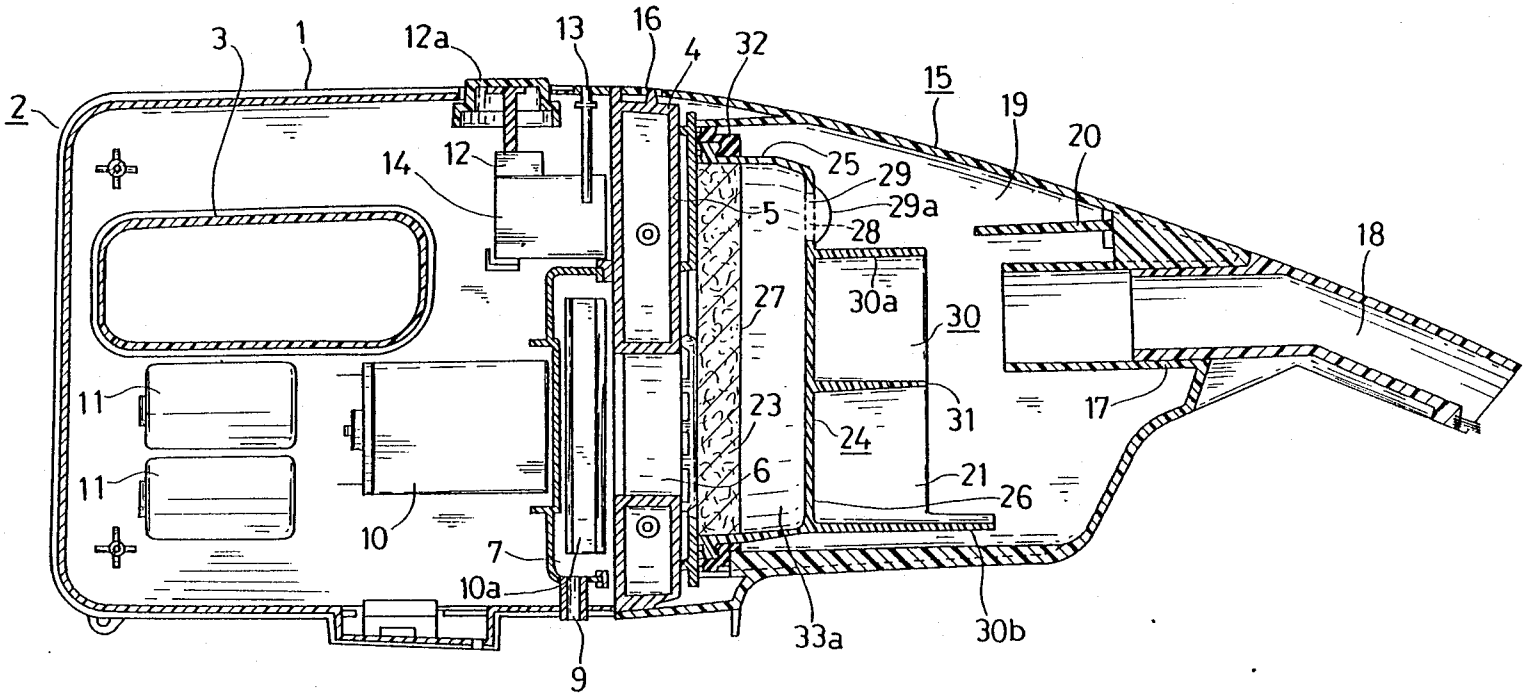
FIG. 1 is a longitudinal sectional view showing the portable vacuum cleaner.

The portable vacuum cleaner of the invention basically comprises a main body case housing a fan motor and having intake and discharge openings, a dust case having a suction part and removably attached to the main body case through a seal member around the intake opening, and a filter housing removably installed in the dust case and a filter accommodated therein to cover the intake opening with the filter. Alterations of the basic construction are not limited to the embodiments to be described below. (See, for example, U.S. Pat. Nos. 4,213,224, 4,142,270, 4,341,540, 4,380,845 4,577,365 and 4,536,914.)

The power source for the fan motor may be supplied from a rechargeable battery (in the case of a cordless model) or from a household receptacle connected directly with an electric cord. (See U.S. Pat. No. 4,574,419; and also see U.S. Pat. Nos. 4,225,814, 4,573,234 and 4,591,777 for rechargeable models.)

According to the present invention, the filter housing has on the intake or suction side thereof an annular wall which projects in an annular form toward the suction part and forms a well for water drawn in from the suction part, and also has a through hole positioned above the annular wall which permits the passage of air drawn in from the suction part.

Because of this structure, most water remaining in the dust case collects in the well and stays there but does not flow into the main body case of the cleaner via the through hole when the cleaner is stood upright with the suction part above the dust case. If water flows into the main body case, for example, the performance of the filter decreases. Moreover, if water passes through the filter and reaches the fan casing, the water drawn in is discharged from the drain holes on the fan casing and the discharge opening. These disadvantages can be eliminated by the present invention.

In addition, according to the present invention, the water collected in the dust case is retained therewithin. In other words, a seal member is peripherally interposed between the dust case and the main body case and/or filter housing so that the water collected in the dust case does not leak therefrom. Unlike a conventional seal member, the seal member in the vacuum cleaner of the present invention is subject to only a small water pressure and will prevent water leakage even if slightly damaged because water is mostly held in the specific water well as mentioned above. This is a desirable advantage for the seal member which is always in contact with dust and water and is subject to damage each time the dust case or filter housing is removed and remounted for the discharge of dust and water.

The annular rib, which is mounted on the suction side of the wall of the filter housing, should have a volume such that it can hold almost all of the water (100 to 150 ml) collected in the dust case. Actually, the inner volume of the annular wall has a somewhat larger volume than the volume of water to be held, i.e., the annular wall is 35 to 40 mm in height and 3600 to 4000 $mm^2$ in opening area.

The portable vacuum cleaner of the present invention is now described with reference to an embodiment shown in the drawings.

The portable vacuum cleaner 2 includes a main body case 1 which has a handle 3 at its rear upper portion and a spigot portion 4 at its front side. The spigot portion 4 has a front wall 5 formed with an intake opening 6. A fan casing 7 communicating with the intake opening 6 is provided within the main body case 1. Each of the opposite side walls of the main body case 1 is formed with air discharge outlets 8 communicating with the fan casing 7. (See FIG. 7.) The main body case 1 is provided in its bottom wall with a drain port 9 communicating with the fan casing 7. The main body case 1 houses a fan motor 10 provided with a centrifugal fan 10*a* which is rotatably disposed within the fan casing 7. Indicated at 11 are rechargeable batteries positioned below the handle 3 and housed in the main body case 1. A power supply switch 12 is also housed in the main body case 1, with its switch button 12*a* projecting from the top of the main body case 1. Indicated at 13 is a light-emitting diode for indicating that the power supply is on, and at 14 a printed circuit board carrying a control circuit.

A dust case 15 removably attached to the front portion of the main body case 1 is in the form of a tube having at its rear portion a socket opening 16 fitting to the spigot portion 4 and having a progressively decreasing diameter toward the front. The dust case 15 is adapted to hold therein dust or dirt, and also water, and further has at its front end a cylindrical suction tube 17. The dust case 15 is flared into a suction nozzle 18 of a large inlet opening which is removably joined to the suction tube 17.

Figure 7:
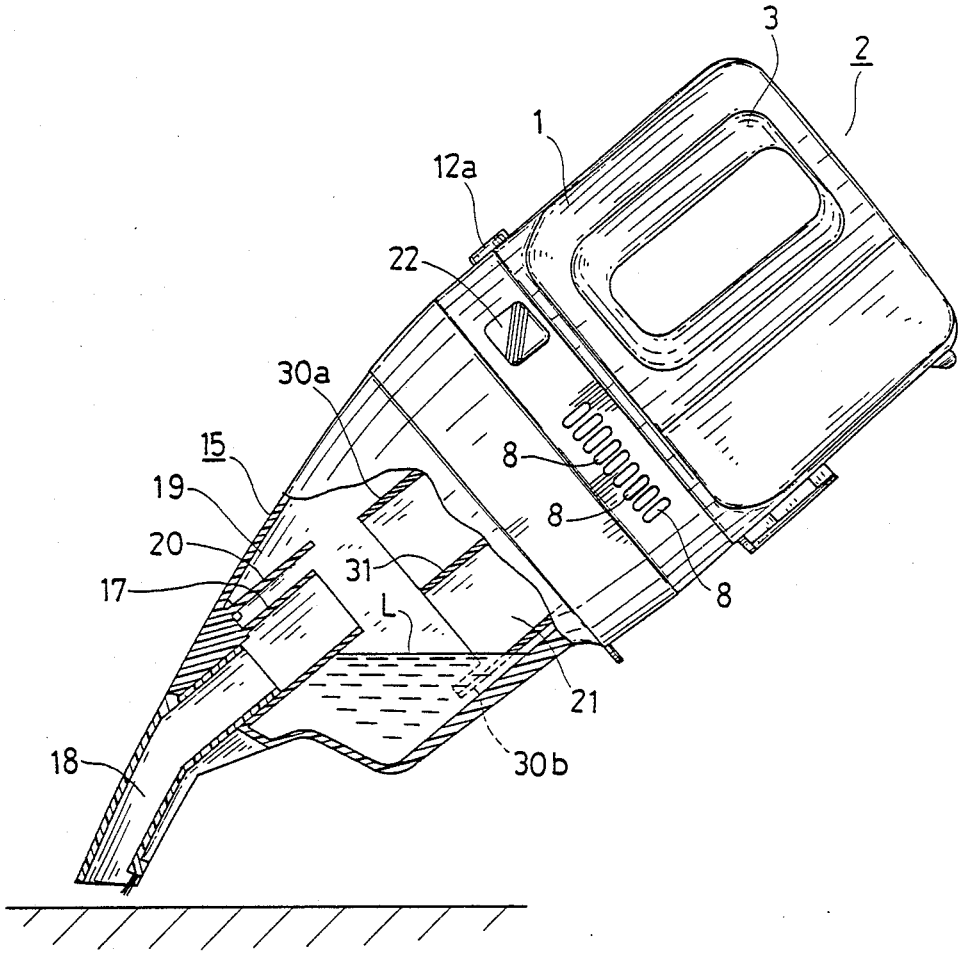
FIG. 7 is a partly sectional view showing the vacuum cleaner in use.

A flat rib 20 is integrally formed on the inside of the dust case 15 along and substantially parallel to the suction tube 17. Thus the flat rib 20 forms the water well 19 at the top the dust case 15. As seen in FIG. 7, a clamping device to engage the dust case 15 with the main body case 1 is released by the push button 22. When the push button 22 is depressed, the dust case 15 is released from the main body case 1.

Figure 2:
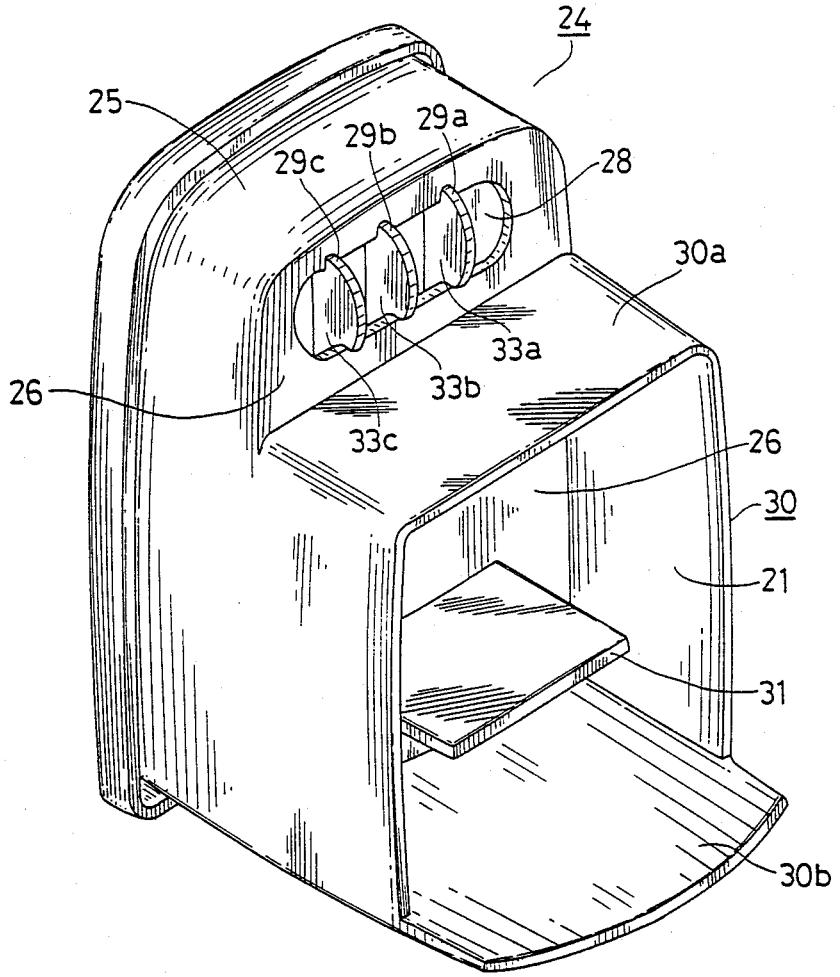
FIG. 2 is a front perspective view showing the filter housing.

A filter 23 for separating dirt from the air drawn in comprises a member made of chemically treated open-cell polyurethane foam board (for example, 10–15 mm thick). The filter 23 is removably accommodated in a filter housing 24, which comprises a filter accommodation portion 27 having an outer frame 25 and a front plate 26, a through hole 28 for the passage of the drawn-in air and which is formed above the front plate 26, and a plurality of ribs 29 having projecting parts 29*a*, 29*b* and 29*c* which extend beyond the upper and lower edges of the through hole 28 and project outwardly from the front plate 26 of the filter housing 24 as shown in FIG. 2. Thus the surface of the front plate 26 is imparted with additional strength.

Figure 3:
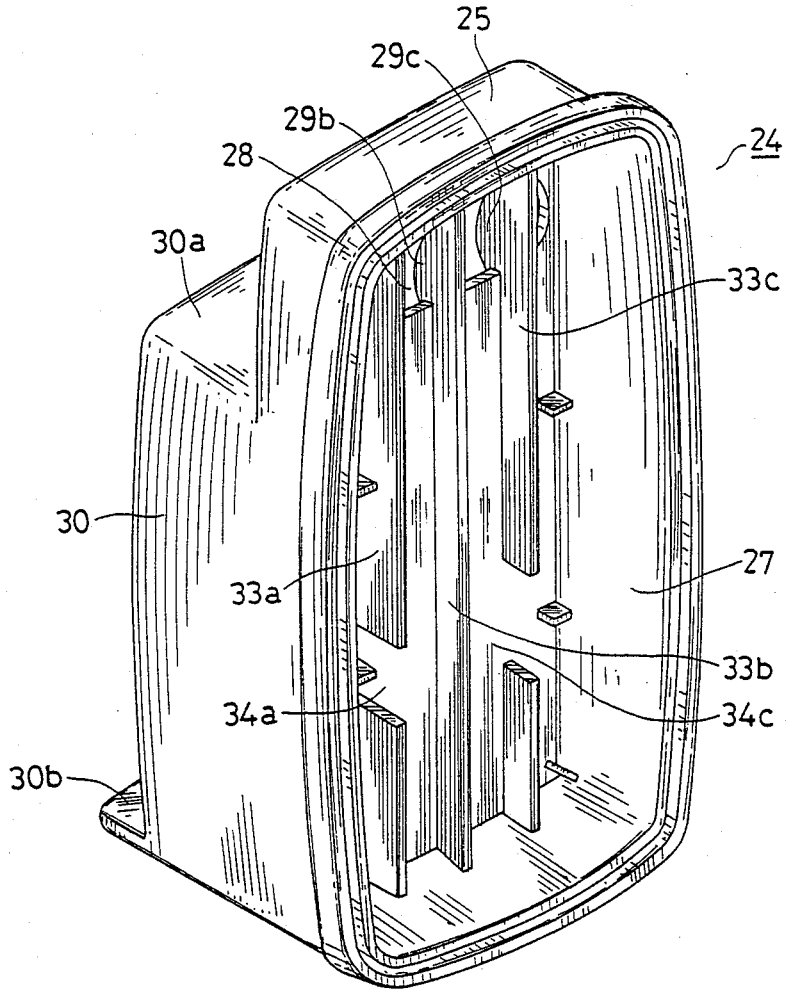
FIG. 3 is a rear perspective view showing the filter housing.
Figure 4:
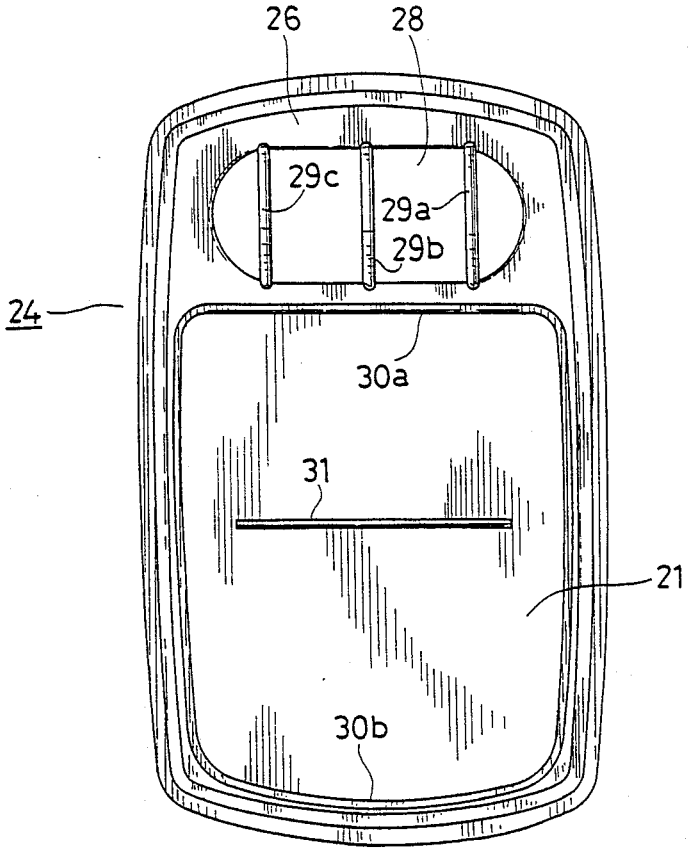
FIG. 4 is a front view showing the filter housing.

The outer frame 25 has a rubber seal member 32 along its outer edge. When the filter housing 24 is fitted into the dust case 15 through the socket opening 16, the filter 23 is so disposed as to cover the intake opening 6. The front plate 26 is provided on its inner side with holding plates 33*a*, 33*b* and 33*c* for the filter 23 and which extend in the vertical direction as shown in FIGS. 2 and 3. The holding plates 33*a*, 33*b* and 33*c* serve also to smooth the flow of air drawn in. The holding plates are formed integrally with the rib 29 formed on the through hole 28 of the filter housing 24.

An annular projecting wall 30 located adjacent the through hole 28 extends outwardly from the front side of the front plate 26 toward the rear opening of the suction tube 17. The upper part 30*a* of the annular projecting wall 30 is positioned above (in the position of the vacuum cleaner 2 illustrated in FIG. 1) the top of the rear opening of the suction tube 17, and its lower part 30*b* extends forwardly and projects beyond the upper part 30*a* to form a guiding tongue. The annular wall 30 and the front plate 26 of the filter housing 24 from the water well 21 which holds water when the main body case 1 of the vacuum cleaner is positioned with the rear opening of the suction tube 17 upward or above it. At the center of the well 21 is a horizontal center rib 31 which projects forwardly from the front plate 26 of the filter housing 24. The center rib 31 damps or inhibits the sloshing and spillage of water in the well 21 when the main body case 1 is moved or vibrates. The upper part 30*a* of the annular wall 30 prevents water-containing dust coming from the suction tube 17 from reaching the through hole 28 directly.

Figure 5:
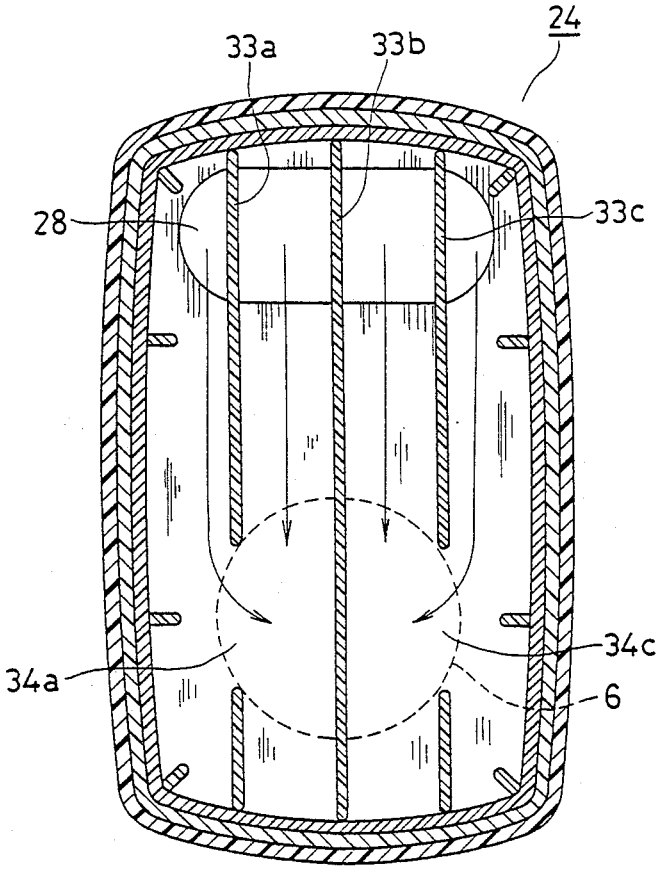
FIG. 5 is a sectional view showing the filter housing taken in the direction at right angles with respect to FIG. 1.
Figure 6:
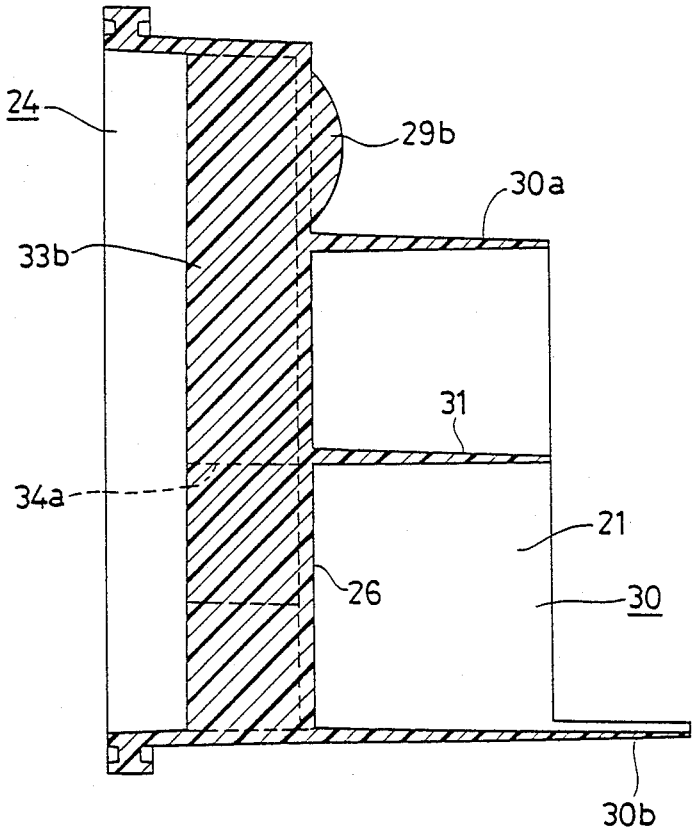
FIG. 6 is a central longitudinal sectional view showing the filter housing.

The filter housing 24 is now described in more detail with reference to FIGS. 2 and 3. There are three pairs of the integral bodies composed of the ribs 29*a*, 29*b* and 29*c* and the holding plates 33*a*, 33*b* and 33*c*. They extend parallel to each other in the vertical direction within the horizontal dimensions of the through hole 28. The outer holding plates 33*a* and 33*c* have notches 34*a* and 34*c*, which cause the air drawn in from the through hole 28 to be guided by the holding plates 33*a*, 33*b* and 33*c* and introduced to the suction opening 6. (The air flow is indicated by arrows in FIG. 5.)

When the switch button 12*a* is depressed, with the handle 3 of the main body case 1 grasped by the user's hand, power is supplied from the rechargeable batteries 11, turning on the light-emitting diode 13 and rotating the fan motor 10 at high speed. Where the dirt to be removed is mixed with water, the dirt and water are drawn in through the suction nozzle 18 along with air. The water and dirt drawn into the dust case 15 decrease in velocity or collide with the well 21 while passing through the long suction tube 17. Thus, the dirt and water are separated from the air drawn in, and they fall into the dust case 15 from the rear opening of the suction tube 17 or from the well 21. Finally, they are collected in the dust case 15. Since the rear opening of the suction tube 17 is extends rearwardly in accordance with the amount of water to be collected under normal use conditions of the vacuum cleaner, the water will not flow backward into the suction tube 17 until the water level L reaches the rear end of the suction tube 17 with the main body case 1 inclined forward and the suction tube 17 inclined downward as shown in FIG. 7. This eliminates the need to provide the suction tube 17 with a safety device such as a flapper valve.

A flat rib 20 is provided in the upper part of the dust case 15, between well-defining annular wall 30 and the side wall of the dust case. The flat rib 20 lies substantially parallel to the extension of the suction tube 17 and extends rearwardly within the dust case 15, terminating beyond the rearward end of the tube 17, This structural arrangement is effective to damp the movement of water in the dust case in certain positions or orientations of the dust case 15. By reason of its projection beyond the rearward end of suction tube 17, the flat rib 20 also affects the free flow of air and water drawn-in through the suction nozzle 18 in its travel toward the through hole 28, thereby discouraging the relatively heavier drawn-in water from flowing directly into the through hole 28 from the suction tube 17 during operation of the vacuum cleaner 2.

When the vacuum cleaner is stood upright, with the rear end of the suction tube 17 downward (or the suction nozzle 18 upward—as for transport of the vacuum cleaner or charging of its battery—and there is undischarged water collected in the dust case 15, water is mostly held in the well 21 formed in the filter housing 24. Battery charging may be performed by placing the main body on the charging stand (not shown). (See, for example, U.S. Pat. No. 4,573,234.) In such an orientation, the water in the well 21 may move and the water level vary as the main body case 1 vibrates and water could run out of the well 21 over the annular wall 30. To prevent the water from sloshing about, or at least damp its movement within the well 21, the center rib 31 is provided. Since water is held in the well 21 when the main body case 1 is positioned with the nozzle 18 upward, the seal member 32 interposed between the main body case 1 and the dust case 15 receives a low water pressure thereon and hence effectively prevents the leakage of water or reduces the leakage of water even where the seal member is slightly damaged. In addition, the lower edge **30*b* projecting forward guides more water to the well 21 when the main body case 1 is inverted from the position as shown in FIG. 7 such that the suction nozzle 18** faces upward. This too reduces the load on the seal means.

The air drawn in through the nozzle 18 is led to the fan casing 7 in the main body case 1 via the through hole 28, the filter 23, and the intake opening 6, and it is finally discharged from the air outlet 8. Even if the separation of air from water in the rear of the suction tube 17 is incomplete in the above-described operation, the filter 23 is effective to separate the water and fine dirt particles from the air stream. Further, even if the filter 23 fails to completely remove water, thus allowing some water to be drawn into the fan casing 7, the air discharging pressure of the fan **10*a* discharges the remaining water from the vacuum cleaner through the drain port 9**.

The dirt and water are dumped after removing the dust case 15 from the main body case 1 by depressing the push button 22 and removing the filter housing 24. The filter 23 is cleaned as removed from the filter housing 24. The batteries 11 are charged while the cleaner is not in use, using a battery charger (not shown).

The projections **29*a*, 29*b* and 29*c* are attached to the through hole 28 of the filter housing 24 in order to prevent or at least discourage the through hole 28 from being clogged by paper and dirt sticking to it. They provide a certain distance between the through hole 28 and the dirt, so that the air drawn in can pass through the through hole 28 even when dirt sticks to the projections 29*a*, 29*b* and 29*c***.

As mentioned above, the portable vacuum cleaner of the present invention is made up of a main body case housing a fan motor and a power supply unit, having a suction tube, a dust case removably attached to the front of the main body, and a filter housing installed in the dust case which separates water-containing dust and air drawn in from the suction tube, a through hole formed at the upper part of the front side of the filter housing through which the drawn-in air passes, and an annular projecting wall extending toward the suction tube from the front side of the filter housing at the lower part of the through hole. The wall and the front plate of the filter housing form a well for water, so that when the main body case is stood upright, water is held mostly in the well, with the result that only a small amount of water remains outside of the well and the seal between the main body case and the dust case receives a reduced water pressure thereon, whereby leakage from the seal is effectively suppressed.

What is claimed is:

1. A portable vacuum cleaner operable for use in concurrent dry and wet operations, comprising:

a main body case having intake and discharge openings;

a fan housed in the main body case between the intake and discharge openings;

a dust case having a suction nozzle adapted to draw in water, air and debris during operation of said vacuum cleaner, said dust case having a top and being removably secured to the main body case adjacent the intake opening so as to completely cover the intake opening;

a filter housing having a through hole, said filter housing being removably installed in the dust case adjacent the intake opening and having an intake side distal from the intake opening, and said through hole being provided for the passage of air and debris drawn in through the suction nozzle during operation of the vacuum cleaner;

a filter disposed in the filter housing so as to cover the intake opening;

a seal member peripherally interposed between the filter housing and the dust case; and an annular projecting wall mounted in the dust case adjacent the intake side of the filter housing and having an open end in opposed relation to the suction nozzle to form a well for storing, during periods of nonuse with said vacuum cleaner oriented so as to upwardly point said suction nozzle, water drawn in through the suction nozzle during operation of the vacuum cleaner;

said through hole in the filter housing being defined between the annular projecting wall and the top of the dust case, the position of the through hole being effective for minimizing passage through said through hole of liquid drawn in through the suction nozzle during operation of the vacuum cleaner.

2. The portable vacuum cleaner of claim 1, wherein the dust case has a bottom opposed to the top thereof and wherein the annular projecting wall includes a guiding tongue extending in the direction of the suction nozzle at a portion of said annular projecting wall substantially adjacent the bottom of the dust case in order to guide water into the water well when the suction nozzle is moved upward into a position for storage.

3. The portable vacuum cleaner of claim 1, wherein the water well includes a center rib surrounded by the annular projecting wall and extending in the direction of the suction nozzle provided for the purpose of suppressing the movement of water in the well.

4. The portable vacuum cleaner of claim 1, wherein the filter housing includes a plurality of ribs, each of said ribs extending over the through hole and projecting toward the suction nozzle so as to discourage clogging of the through hole by relatively large pieces of debris drawn in during operation of the vacuum cleaner.

5. The portable vacuum cleaner of claim 1, wherein the filter housing includes a plurality of substantially parallel filter holding plates projecting from an inside surface thereof for holding the filter in position and providing a path for uninterrupted air flow towards the filter.

6. The portable vacuum cleaner of claim 5, wherein each of the filter holding plates is provided with at least one notch for guiding air along the plate to the intake opening.

7. The portable vacuum cleaner of claim 1, wherein the filter is formed of open-cell polyurethane foam.

8. The portable vacuum cleaner of claim 1, wherein the dust case includes a suction port substantially opposed to the water well and extending in the direction thereof and wherein the suction nozzle is adapted to be fitted into the suction port.

9. The portable vacuum cleaner of claim 8, wherein the suction nozzle is adapted to be removably fitted into the suction port.

10. The portable vacuum cleaner of claim 8, wherein the dust case includes a flat rib provided between the top of the dust case and the suction port and extending in the direction of the main body case so as to form a second water well which is useful when the vacuum cleaner is in an inverted position.

* * * * *